US012215463B2

(12) United States Patent
Salas et al.

(10) Patent No.: US 12,215,463 B2
(45) Date of Patent: Feb. 4, 2025

(54) PROCESS FOR PRODUCING PAPER OR BOARD AND A PRODUCT THEREOF

(71) Applicant: KEMIRA OYJ, Helsinki (FI)

(72) Inventors: Diego Salas, Madrid (ES); Jinho Lee, Seoul (KR); Jan-Luiken Hemmes, Bergisch Gladbach (DE)

(73) Assignee: Kemira Oyj, Helsinki (FI)

( * ) Notice: Subject to any disclaimer, the term of this patent is extended or adjusted under 35 U.S.C. 154(b) by 35 days.

(21) Appl. No.: 17/414,387

(22) PCT Filed: May 22, 2019

(86) PCT No.: PCT/FI2019/050396

§ 371 (c)(1),
(2) Date: Jun. 16, 2021

(87) PCT Pub. No.: WO2020/128144

PCT Pub. Date: Jun. 25, 2020

(65) Prior Publication Data

US 2022/0090319 A1 Mar. 24, 2022

(30) Foreign Application Priority Data

Dec. 17, 2018 (FI) ..... 20186091

(51) Int. Cl.
*D21H 11/18* (2006.01)
*D21F 1/00* (2006.01)
(Continued)

(52) U.S. Cl.
CPC ..... *D21F 1/0018* (2013.01); *D21H 11/18* (2013.01); *D21H 17/26* (2013.01); *D21H 17/29* (2013.01);
(Continued)

(58) Field of Classification Search
CPC ..... D21H 17/26; D21H 17/55; D21H 17/56; D21H 11/18; D21H 17/29; D21H 21/20; D21H 23/04; D21F 1/0018; D21J 1/00
See application file for complete search history.

(56) References Cited

U.S. PATENT DOCUMENTS 2,729,561 A 1/1956 Marrone
5,131,982 A * 7/1992 St. John ..... D21C 5/022 162/DIG. 4
(Continued)

FOREIGN PATENT DOCUMENTS

DK 2662419 T3 * 9/2015 ..... D21H 17/69
EP 0437816 A1 7/1991
(Continued)

OTHER PUBLICATIONS

Gary A. Smook, Handbook for Pulp and Paper Technologists, Angus Wilde Publications, Second Edition (Year: 1992).*
(Continued)

*Primary Examiner* — Emmanuel S Luk
*Assistant Examiner* — Stephen M Russell
(74) *Attorney, Agent, or Firm* — Meunier Carlin & Curfman LLC

(57) ABSTRACT

The present invention provides a process for producing paper or board, comprising slushing a stock of dried fibres in a slushing system comprising a pulper, and/or feeding a stock of never-dried fibres in a fiber line of an integrated paper mill; deflaking and/or refining the stock in a deflaker and/or a refiner, optionally diluting the deflaked and/or refined stock, directing the deflaked and/or refined stock to a headbox, forming a web, and drying the web, wherein a polymeric paper making additive is added to one or more of the stocks of dried fibres and never-dried fibres before
(Continued)

deflaking and/or refining of the stock. The present invention further provides paper and board with improved properties.

19 Claims, 1 Drawing Sheet

(51) Int. Cl.

| | |
|---|---|
| ***D21H 17/26*** | (2006.01) |
| ***D21H 17/29*** | (2006.01) |
| ***D21H 17/55*** | (2006.01) |
| ***D21H 17/56*** | (2006.01) |
| ***D21H 21/20*** | (2006.01) |
| ***D21H 23/04*** | (2006.01) |
| ***D21J 1/00*** | (2006.01) |

(52) U.S. Cl.
CPC ..... *D21H 17/55* (2013.01); *D21H 17/56* (2013.01); *D21H 21/20* (2013.01); *D21H 23/04* (2013.01); *D21J 1/00* (2013.01)

(56) References Cited

U.S. PATENT DOCUMENTS

| | | | | |
|---|---|---|---|---|
| 5,169,497 | A * | 12/1992 | Sarkar | D21H 17/005 162/168.3 |
| 5,393,380 | A | 2/1995 | Reed et al. | |
| 5,876,563 | A | 3/1999 | Greenwood | |
| 9,976,256 | B2 | 5/2018 | Kajanto et al. | |
| 2003/0127210 | A1 | 7/2003 | Pelletier et al. | |
| 2008/0190576 | A1 | 8/2008 | Champ et al. | |
| 2017/0320969 | A1* | 11/2017 | Axrup | D21H 11/18 |
| 2019/0309476 | A1* | 10/2019 | Karisalmi | D21H 11/12 |

FOREIGN PATENT DOCUMENTS

| | | | |
|---|---|---|---|
| FI | 20175545 | A1 | 12/2018 |
| FR | 1442792 | | 6/1966 |
| WO | 1995/033096 | A1 | 12/1995 |
| WO | 2010092239 | A1 | 2/2010 |
| WO | 2013167420 | A1 | 11/2013 |
| WO | 2015087293 | A1 | 6/2015 |
| WO | 2017/103335 | | 6/2017 |
| WO | 2017/162920 | | 9/2017 |
| WO | 2018/096211 | | 5/2018 |
| WO | 2018/178518 | | 10/2018 |
| WO | 2018229337 | A1 | 12/2018 |

OTHER PUBLICATIONS

International Search Report and Written Opinion dated Jul. 15, 2017, from International Application No. PCT/FI2019/050396, 10 pages.
Search Report issued Apr. 17, 2019 from Finnish Application No. 20186091, 2 pages.
Zhivkov, Alexandar Metodiev, "Electric properties of carboxymethyl cellulose", Cellulose-fundamental aspects, 2013, pp. 1-31.
Notice of Opinion from Korean patent Office in corresponding application 10-2021-7020992. Dated Jan. 30, 2024.
Notice of Opposition in corresponding European patent EP3899136, dated on Sep. 27, 2023. 28p.
Notice of Opposition in corresponding European patent EP3899136, dated onSep. 25, 2023. 20 p.
Klemm, D. et al. 2011. Nanocelluloses: A New Family of Nature-Based Materials. Angew. Chem. Int. Ed. 50, 2-31.
Ek, M. et al. 2009. Pulping Chemistry and Technology. pp. 438-439.
Hellstrom, P. et al. 2014. Fenton pre-treated microfibrillated cellulose evaluated as a strength enhancer in the middle ply of paperboard. Nordic Pulp & Paper Research Journal vol. 29 No. (4) . pp. 732-740.
Backstrom M. et al. 2009. Studies of the influence of deflocculants and flocculants on the refining efficiency on a pilot scale. Nordic Pulp and Paper Research Journal. vol. 24, No. 3 pp. 319-326.
Mou H. et al. 2013. Advanced Studies on the Topochemistry of Softwood Fibres in Low-Consitency Refining as analyzed by FE-SEM, XPS, and ToF-SIMS. BuiResources 8(2), 232-2336.
Andersson, S. et al. 2012. Effect of long fibre concentration on low consistency refining of mechanical pulp. Nordic Pulp and Paper Research Journal, vol. 27 No. (4) pp. 702-706.
Gharekhani, S. et al. 2015. Basic effects of pulp refining on fiber properties—A review. Carbohydrate Polymers 115. pp. 785-803.
Kangas, H. et al. 2014. Characterization of fibrillated celluloses. A short review and evaluation of characteristics with a combination of methods. Nordic Pulp & Paper Research Journal VI. 29 No. (1), pp. 129-143.
Bajpai, P. 2010. Environmentally Friendly Production of Pulp and Paper. Chapeter 5 in Cleaner Production Measures in Pulp and Paper Processing. pp. 188-189.
Notice of Allowance issued on Oct. 21, 2024, in Korean Patent Application No. 21-2021-7020992.
Office Action issued on Oct. 30, 2024, in Brazilian Application No. 112021008948-9.

* cited by examiner

PROCESS FOR PRODUCING PAPER OR BOARD AND A PRODUCT THEREOF

This is a U.S. national stage application of the international application number PCT/FI2019/050396 filed on May 22, 2019, and claiming priority of FI20186091 filed on Dec. 17, 2018, the contents of both of which are incorporated herein by reference.

FIELD OF THE INVENTION

The present invention relates to a process for producing paper or board. The present invention additionally relates to a paper and board produced with said method.

BACKGROUND ART

In an effort to improve properties of paper, synthetic resins were first used in the early 1940's and 1950's, for example, dry strength agents such as acrylamide polymers. Polymers of polyacrylamide were found effective as dry-strength resins. While other types of synthetic dry-strength resins are reported in the literature, commercial products are primarily based on acrylamide.

There are many benefits to be gained from the use of strength additives. Refining can be reduced while maintaining paper strength, resulting in energy savings. Strength properties can be maintained while substituting expensive high-quality fiber material with a lower-strength, lower-cost furnish. In addition, dry strength can be increased without a corresponding increase in apparent density, as would be the case with increased refining.

In addition to the afore-mentioned acrylamide polymers, various other compositions provide strength properties. Many of these compositions can be classified as being cationic non-acrylamide-containing polymers, for example, vinyl pyridine and copolymers thereof, and condensation polymers of polyamines, ketones and aldehydes. In addition to synthetic strength agents also natural additives have been used for improving strength properties of paper.

Polymers are used not only for improving paper properties but also as process chemicals for improving paper machine performance, such as retention and drainage. Typically, several different polymer products need to be added at same paper machine to achieve the targeted paper properties and process efficiency. Regarding transportation efficiency and product shelf life, it would be ideal if the polymers were in dry form. However, dry polymers need to be dissolved under carefully controlled conditions to avoid formation of surface wet lumps or gels of undissolved or incompletely dissolved polymer, sometimes referred to as fisheyes. Not only the form of the polymer, but also its molecular weight affects the dissolving behaviour. Generally, the higher the molecular weight of the polymer the more difficult or time consuming it is to dissolve completely.

Incompletely dissolved polymer gels or fisheyes are highly undesired as they tend to disperse slowly, clog small orifices slowing production rate, deposit on equipment, and appear as spots in the paper, even causing pinholes. Especially modern papermaking processes with high-speed machines are very sensitive to deposits.

As a precautionary measure process equipment are being regularly washed and cleaned, leading to downtime and loss of production. The deposits may also reduce the paper quality in such amount that web breakages occur, or cause holes or dark spots to the paper that in extreme situation may lead to rejection of the paper.

Even low level of deposits may lead to a quality reduction, and to problems in further processing of the produced paper such as web breakages during printing, and contamination of printing machines. While the fisheyes may be removed after dissolving the polymer e.g. by filtering or centrifuging, this requires operation and maintenance of additional equipment, and part of the polymer is wasted.

Even though it has been intensively studied to find ways to improve paper properties and to develop new improved processes, there is still need for more simple and efficient processes for producing paper and board with improved properties. It is also desirable to provide more environmentally friendly ways for making of paper or board.

SUMMARY OF THE INVENTION

An object of the present invention is to provide a method for producing paper or board with improved features.

Another object of the present invention is to provide a simplified and more efficient method for producing paper or board.

A further object of the present invention is to provide a paper and board product having improved features, especially improved strength.

Another object of the present invention is to improve efficiency of a polymeric paper making additive, especially of high molecular weight, in improving strength of a paper or board, and retention and dewatering of the paper or board manufacturing process.

Typical dosage point of polymeric papermaking additives, such as strength additives like CMC, in paper or board manufacturing process is in thick stock before dilution pump. Another typical dosage point of polymeric papermaking additives, such as retention polymers, is in thin stock, after dilution of the thick stock with white water but before headbox. In conventional paper and board manufacturing processes polymeric paper making additives, such as strength additives, are carefully dissolved in water and even filtered prior to addition to the thick and/or thin stock.

Typically, polymeric paper making additives must be completely dissolved before use in paper making process to avoid difficulties in running the process and/or defects in the produced paper caused by residues of incompletely dissolved polymer. In prior paper and board manufacturing processes high molecular weight polymeric paper making additives, including strength additives, are dissolved in water, and often further diluted, prior to addition to the papermaking fibre stock. This requires use of complex methods, expensive and bulky dissolution equipment and tanks, and high amounts of dissolving and dilution water. The dissolution method and equipment may vary depending on the form of the additive. For products in powder (solid) form, a good dispersion of powder grains in the water and agitation for about one hour is commonly needed for reaching maturation. Sufficient agitation is needed to keep the product in suspension. After maturation, a uniform, viscous polymer solution is obtained. Polymeric paper making additives in emulsion form typically require violent agitation when contacting the emulsion with water. Compared to polymer powders, emulsions have quicker maturation, and the polymer solution can be used immediately, although short aging is preferred. For industrial applications high molecular weight polymers are not commonly available as ready-made liquid water solutions, as the polymer content would need to be extremely low for the viscosity of the solution to be handleable.

It has now been surprisingly found that if polymeric paper making additive, especially of high molecular weight, is added to a fibre stock before deflaking and/or refining of the stock, even as dry powder and/or as an aqueous dispersion, the above mentioned problems can be alleviated or solved and surprisingly the efficiency of the polymeric paper making additive, such as those having high molecular weight, on one or more of various paper strength characteristics, dewatering, and retention for example of filler (ash), fines, and paper making chemicals, can be enhanced.

With the process of the present invention it is possible to distribute the polymeric paper making additive, especially of high molecular weight, more homogeneously to the fibre stock, thus improving properties of produced paper and board, but also enhancing runnability.

With the process of the present invention the polymeric paper making additive, especially of high molecular weight, interacts better with the components in the stock including fibres, fines and other paper/board making chemicals.

By adding the polymeric papermaking additive to the fibre stock before deflaking and/or refining, the targeted deflaking level and/or refining degree may be attained with lower energy consumption. The main target of refining is to improve bonding ability of the fibres for improving strength and smoothness of paper or board. With the present process it is possible to meet or even exceed the targeted refining degree, expressed as Canadian freeness, with less energy consumption, thereby improving bonding ability of the fibres which in turn may allow reduction of total fibre content, or substitution of expensive high quality fibres with lower strength e.g. recycled fibre materials, while maintaining strength properties of the produced paper or board.

In a preferred embodiment the polymeric paper making additive is a strength additive, thereby providing further improvement in the strength such as dry strength of the paper or board. As target strength specifications may be obtained by applying less refining energy, some of the known drawbacks of refining, such as higher density or lower bulk, decreased tear strength, drainage, dewatering, absorbency, air permeability, and brightness, may be reduced or even eliminated.

Also the decrease in intrinsic strength of the fibres may be reduced, so that the fibres can take higher number of recycling cycles. With the process of the present invention the fibre to fibre bonding may be enhanced, and thus the produced paper or board may be less brittle and more elastic. Such paper or board may be folded without breaking the paper/board structure. Furthermore, the present process provides improved smoothness and better control on paper/board porosity and thus better control on penetration of surface treatment compositions and printing inks, thereby improving uniformity, performance and quality of surface treatments and printing.

Yet another advantage of the present invention is that the equipment to make the aqueous dispersion of the polymeric paper making additive, especially of high molecular weight, may be greatly simplified and far less bulky compared to equipment needed for complete dissolution. When the polymeric paper making additive is added to the process as powder, even the need for dispersing equipment is eliminated. The dissolution, further dilution, filtering and/or centrifuging steps can be avoided because the polymeric paper making additive is added to the fibre stock before deflaking and/or refining providing extended time for the polymer to dissolve and distribute homogenously to the fibre stock. This makes use of powdery polymeric paper making additive possible even at small papermaking machines and paper mills with limited space, and investments in expensive and bulky equipment can be avoided.

As the polymeric papermaking additive may spend less time in contact with water or is not contacted with water at all before being added to the papermaking process, degradation of the polymer by microbiological or enzymatic activity may be avoided. This is advantageous especially when using natural polymers as they often contain residual enzymes, microbes and/or microbial spores. Additionally due to the shorter or no contact time with water before usage, adverse effects of low quality water e.g. having high hardness, conductivity, or alkalinity, on the polymer may be reduced.

As the polymeric papermaking additive does not need to be dissolved, but may be just dispersed in water, performance loss caused by mechanical degradation of the polymer chains due to prolonged and/or vigorous agitation may be avoided. This is advantageous especially when using high molecular weight polymeric papermaking additives.

Additionally the present invention provides improved deposit control, resulting in less deposits on the papermaking machine and/or on paper. This is contributed by introducing less polymer insolubles to the papermaking process, reducing risk of small spots of incompletely dissolved polymer on paper or even pinholes that could disturb surface treatment and print quality and increase risk of web breakage e.g. during paper manufacture or coating.

The improved deposit control may be contributed also by enhanced retention of hydrophobic substances, such as residual pitch, stickies, surface size, latex, creping adhesives etc. that may be present especially in mechanical pulp, semi-chemical pulp such as chemi-thermomechanical pulp (CTMP), recycled fibre materials (RCF), and broke such as coated, surface-sized and creped broke.

Also retention of internal sizing agents may be improved when manufacturing sized paper grades, thereby providing improved sizing performance such as improved Cobb value. Without wishing to be bound by any theory it is believed that the improved retention of hydrophobic substances, including internal size, is contributed at least by improved fines retention achieved by the present process, as hydrophobic substances tend to associate with the fines. The more homogeneously distributed polymeric papermaking additive may facilitate retaining the fines and/or the hydrophobics associated thereto more evenly to the fibres.

The present process may also attain improved opacity and/or brightness, as the more evenly distributed polymeric papermaking additive enhances more even retention of fillers (ash) and optical brighteners (OBA). With the present process filler/ash levels may be increased in the paper, while maintaining the paper strength.

Improved retention of cationic papermaking agents such as cationic starch and cationic wet strength resins, and of hydrophobic substances such as internal sizing agent, and residual pitch, stickies, surface size, latex, creping adhesives etc. also contribute to the quality of circulating waters, and can be seen as reduced BOD and/or COD.

Compared to conventional solutions, the present disclosure produces better technical effects, including improved quality, increased productivity, energy saving, and reduced environmental pollution or improved control thereof.

Further advantages of the present disclosure are described and exemplified in the following Figures and Detailed Description. The embodiments and advantages mentioned in this specification relate, where applicable, both to the process and the paper or board according to the present disclosure, even though it is not always specifically mentioned.

FIGURES

DETAILED DESCRIPTION

Figure 1:
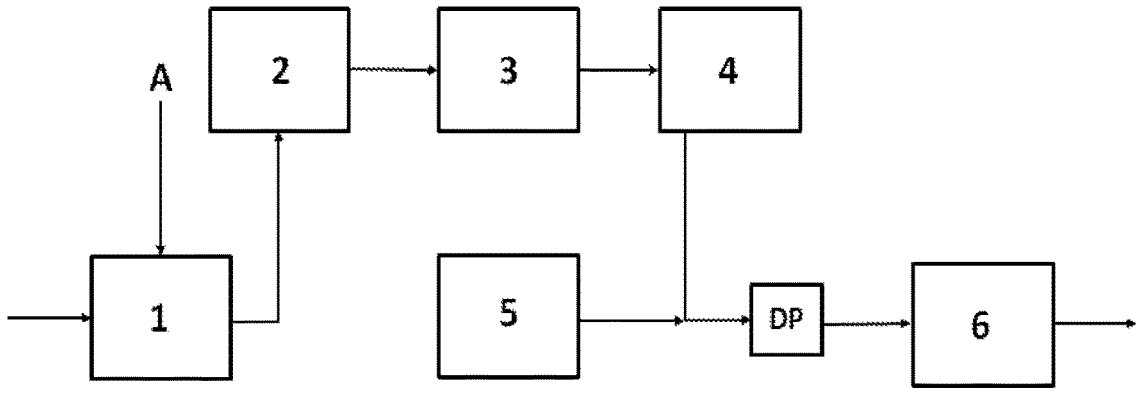
FIG. 1 represents an example of the process according to the present invention, wherein high molecular weight polymeric paper making additive is added to pulper.

The present invention provides a process for producing paper or board. More particularly the present invention provides a process for producing paper or board, comprising slushing a stock of dried fibres in a slushing system comprising a pulper, and/or feeding a stock of never-dried fibres in a fiber line of an integrated paper mill;

deflaking and/or refining the stock in a deflaker and/or a refiner, optionally diluting the deflaked and/or refined stock, directing the deflaked and/or refined stock to a headbox, forming a web, and drying the web, wherein a polymeric paper making additive having an intrinsic viscosity of at least 0.5 dl/g is added to one or more of the stocks of dried fibres and never-dried fibres before deflaking and/or refining the stock.

As used herein, by a slushing system is meant the operations and equipment at paper mill starting from a pulper up to a deflaker and/or a refiner. By the pulper is meant a unit for defibering the dried pulps, such as dry market pulp, paper machine broke, or recycled fibre materials in water, into a pumpable fibre stock. The pulper may be any pulper known in the art suitable for pulping dried pulps batch-wise or continuously. Typical pulpers contain a vat, rotor and drive equipment, and may be organized as e.g. vertical or horizontal pulpers.

By adding the polymeric paper making additive before deflaking and/or refining the stock is meant that at the time the stock enters the deflaking and/or refining stage, at least part of the polymeric paper making additive has already been added to the stock, while the rest of the additive may be added during the deflaking and/or refining.

It was surprisingly found that when a polymeric paper making additive is added to the fibre stock before deflaking and/or refining of the fibres, the polymer gets efficiently dissolved and distributed into the fibre stock. While the underlying mechanism is not fully understood, the polymeric paper making additive seems to contribute, potentially via its dispersing and/or stabilizing effect, to separation, wetting and flexibility of the fibres after deflaking, and to the level of and balance between external and internal fibrillation and fibre straightening after refining. The dispersing and/or stabilizing effect may even enhance stability and protrusion of the external fibrils, thereby further contributing to bonding ability.

In a preferred embodiment the polymeric paper making additive is added to the pulper, as thereby the polymer may be even more efficiently dissolved and distributed throughout the stock, providing further enhancements in deflaking and/or refining.

Term "integrated paper mill" is known for a skilled person in the art. In brief, an integrated paper mill is a manufacturing complex in which essentially all pulping and papermaking operations are conducted at one site. The stock that is manufactured and subsequently used at the integrated paper mill is of never-dried fibres, i.e. the stock is not dried before manufacturing the paper at the site. Integrated paper mills can additionally use some dried fibres. If all of the stock manufactured at the integrated mill is not used at the site, the excess may be dried into market pulp and sold to other paper mills.

By term "fibre line of the integrated paper mill" is meant here lines i.e. pipes that are after chip and bleaching lines but before deflaker(s) and/or refiner(s) of an integrated paper mill. The fibre lines of an integrated paper mill contain a stock of never-dried fibres in form of a pumpable slurry.

By dried fibres are meant e.g. dry market pulp available for example as bales, or paper machine broke, such as coated or uncoated broke, or recycled fibre materials, such as OCC. Dried fibres generally refer to cellulosic materials that have been dried at least once during their lifetime to solids content of at least 60%, typically to at least 70%, such as to at least 80% or to at least 90%. Dried fibres are used herein to distinguish from never-dried fibres that are obtainable as undried directly from pulp mill.

Dried and never-dried fibres have very different characteristics and properties. For example, dried fibres swell less, provide enhanced dewatering and higher paper machine speeds, but impaired paper strength, compared to never-dried fibres. The surface area of dried fibres is smaller than that of never-dried fibres, due to irreversible closure of pores during drying. With increased refining, the fibre surface area increases only a little for never-dried fibres but substantially for dried fibres.

Preferably the polymeric paper making additive is added to the stock before the deflaker and/or refiner as a powder and/or as an aqueous dispersion. As used herein by aqueous dispersion is meant that the polymeric paper making additive is dispersed, and optionally at least partly hydrated, but still mainly or completely undissolved. An aqueous dispersion may be prepared shortly before addition to the process. It is advantageous to add the polymeric paper making additive as an aqueous dispersion for easy dosing e.g. by pump. The aqueous dispersion of the polymeric paper making additive may have any suitable concentration, such as 1 wt. %. The aqueous polymeric paper making additive dispersion may be prepared by any known method. No additional equipment is needed for dissolving, diluting or filtering the additive prior to adding it to the paper making process.

While the underlying mechanism is not fully understood, it is believed that when a polymeric paper making additive is added to the fibre stock before deflaking and/or refining of the fibres, the polymer gets efficiently dissolved and distributed into the fibre stock, and potentially via its dispersing and/or stabilizing effect contributes to separation, wetting and flexibility of the fibres after deflaking, and to the level of and balance between external and internal fibrillation and fibre straightening after refining. The dispersing and/or stabilizing effect may even enhance stability and protrusion of the external fibrils, thereby further contributing to bonding ability.

Preferably after the deflaking and/or refining, the stock has Schopper-Riegler (° SR) value of at most 50, preferably at most 40, more preferably at most 35, such as 20-50, preferably 20-40, more preferably 25-35, as measured according to ISO 5267-1:1999. The lower the SR value the better the dewatering properties of the stock, but with lower strength characteristics.

In a preferred embodiment the polymeric paper making additive is added to the pulper, as thereby the polymer may be even more efficiently dissolved and distributed throughout the stock. Pulper addition may be especially beneficial when the polymeric paper making additive is of high molecular weight. When added to the pulper, the dispersing and/or stabilizing effect of the polymeric paper making additive may contribute to improved defibering of flakes and fibre bundles already during slushing, and thereby to further enhancements in subsequent deflaking and/or refining. The slushing may be enhanced to such a degree that no deflaking is needed before refining. Additionally when added to the pulper, the dispersing and/or stabilizing effect of the polymeric paper making additive may contribute to dispersion and stabilization of pigments, hydrophobic substances, such as residual pitch, stickies, surface size, latex, creping adhesives etc., as soon as those are liberated from the stock of dried fibres that is being slushed, thereby inhibiting agglomeration of these substances. Pigments and/or hydrophobic substances may originate especially from recycled fibre materials (RCF), broke such as coated, surface-sized and creped broke, mechanical pulp, and semi-chemical pulp such as chemi-thermomechanical pulp (CTMP).

The aqueous dispersion of the polymeric paper making additive may be added with a pump to the stock before deflaking and/or refining, especially to a pulper or to fibre lines of integrated paper mill.

The powder may be added to the stock even as such with any conventional feeder e.g. with a hopper, a screw feeder, or a heated screw feeder wherein the additive melts a bit before entering the stock, before deflaking and/or refining, especially to a pulper.

The polymeric paper making additive may be a powder, an inverse emulsion, a dehydrated inverse emulsion, or a stabilized dispersion. Various high molecular weight polymers are available in these forms. Preferably the polymeric paper making additive is a powder.

As used herein, by powder is meant any dry particulate product, such as beads. A polymeric paper making additive in form of a powder may comprise synthetic and/or natural polymer. It may have a relatively high polymer content such as at least 80 weight-%, preferably at least 85 weight-%, more preferably at least 90 weight-%. Powder form is preferred as it is easy and cost-efficient to transport and store, remains stable for long periods and is resistant towards microbiological degradation.

A polymeric paper making additive in form of a powder may be added to the present process as such, or as an aqueous dispersion. By inverse emulsion is meant an emulsion having hydrophobic liquid as continuous phase with polymer containing water droplets dispersed in the hydrophobic liquid. A polymeric paper making additive in form of an inverse emulsion may contain a synthetic polymer obtained by inverse emulsion polymerization. Such inverse emulsions may have polymer content of e.g. about 10-40 w %, but if dehydrated, the polymer content may be much higher e.g. 60 w %.

A polymeric paper making additive in form of a stabilized dispersion may contain a synthetic polymer obtainable by polymerizing monomers in an aqueous solution containing salt(s) and/or stabilizing polymer(s) keeping the synthetic polymer as dispersed in the salt and/or polymer stabilized aqueous solution, preventing it from dissolving. Polymeric paper making additives in form of an inverse emulsion, a dehydrated inverse emulsion, or a stabilized dispersion may be added to the present process as such or as further diluted aqueous dispersions.

Depending on application and desired features of the paper and board, low or high molecular weight polymeric paper making additive may be selected as the additive to be added to the present process.

Low molecular weight polymeric paper making additives, such as low molecular weight carboxymethylcellulose (CMC), are typically very soluble in water. Typically, the more there are charged groups in the polymeric papermaking additive, the easier it is to dissolve in water. The commonly available grades of low molecular weight CMC typically have high substitution degree and low viscosity, so they are well dissolved before addition and are easier to distribute to the stock during the papermaking process. The present process may provide the benefit of more even distribution of the low molecular weight polymeric paper making additive to the stock.

High molecular weight polymeric paper making additives, such as high molecular weight CMC, provide improved strength properties and retention compared to low molecular weight additives. However, the high molecular weight polymeric papermaking additives such as CMC have longer dissolution time and are more difficult to distribute to the stock because of the high viscosity of the polymer solution. The present process may provide the benefit of complete dissolution and more even distribution of the high molecular weight polymeric paper making additive to the stock.

As used herein, by high molecular weight polymeric papermaking additive is meant a polymeric papermaking additive having an intrinsic viscosity of at least 0.5 dl/g.

In a preferred embodiment the polymeric papermaking additive has intrinsic viscosity of at least 0.5 dl/g, preferably at least 1 dl/g, more preferably at least 2 dl/g. Intrinsic viscosities are obtainable in a known manner, for example by measuring average flow time with an Ubbelohde capillary viscometer (0 C) for a series of dilutions having different polymer contents in aqueous NaCl solution (1 N), at 25° C., calculating specific viscosity from corrected average flow time, dividing the specific viscosity by the concentration to obtain reduced viscosity for each dilution, plotting reduced viscosity as function of concentration, and reading the Y-axis intercept to give the intrinsic viscosity. For determining intrinsic viscosity of microfibrillar cellulose (MFC), ISO 5351:2010 method may be used. In an embodiment the polymeric paper making additive has a viscosity of at most 10 000 mPas as measured from 1 weight-% aqueous polymer solution (dry/dry) using Brookfield LVF viscometer, spindle 4, 30 rpm, at 25° C.; preferably of 50-5500 mPas, more preferably 300-5500 mPas as measured from 2 weight-% aqueous polymer solution (dry/dry) using Brookfield LVF viscometer, spindle 3, 30 rpm, at 25° C.

Generally, the intrinsic viscosity, or the solution viscosity, of the polymeric paper making additive is proportional to, or reflects, the molecular weight of the polymer. Typically the higher the intrinsic or solution viscosity is, the higher is the molecular weight. High molecular weight polymers are sensitive to mechanical degradation. Too vigorous or prolonged agitation chops the molecules thereby causing decrease in the desired efficiency. Also microbiological activity may cause degradation of the polymer chains, especially of natural polymers, so polymer solutions should be used relatively soon after preparation. Additionally, solutions of cationic polymers may lose their efficiency due to hydrolysis of cationic groups, especially if dissolved or diluted in non-pure water, so fresh solutions would need to be prepared each day. The water quality requirements for dissolving paper making additives are often tight, while the availability of clean water at paper mills is limited due to increased environmental awareness and increasingly closed water circulations. Dissolving and/or diluting with low quality water, e.g. with high hardness, conductivity, alkalinity, or extreme pH, may decrease solubility and performance of the polymeric paper making additive.

With the present process the above drawbacks may be reduced or avoided, even when using a high molecular weight polymeric paper making additive. It is believed that dissolving the polymer in the fibre stock shields the polymer chains from mechanical degradation, compared to subjecting the polymer to shear forces in conventional dissolution equipment.

Without wishing to be bound by any theory, adding papermaking polymers that have intrinsic viscosity of at least 0.5 dl/g to the stock at an early stage, e.g. to pulper, is especially advantageous as due to their high molecular weight they do not get completely absorbed into fibre pores and voids, but at least part of the molecule remains available for interacting effectively with other components in the stock, such as fines and other paper/board making chemicals. Unexpectedly the performance of the high molecular weight polymeric paper making additives is not lost by the early addition, despite of the subsequently applied high mechanical forces known to degrade high molecular weight polymers.

In an embodiment, the polymeric paper making additive comprises at least one synthetic polymer, natural polymer, or any combination thereof. As used herein by synthetic polymers are meant polymers derived by polymerizing monomers, and by natural polymers are meant polymers derived by extracting from naturally occurring raw materials, and optionally derivatizing by chemical and/or physical modifications to obtain characteristics the natural polymer wouldn't otherwise possess.

In an embodiment the synthetic polymer comprises at least one polyacrylamide, polyacrylic acid, or a copolymer of acrylamide and at least one of anionic monomers, cationic monomers, hydrophobic monomers, or any combination thereof. The synthetic polymer may additionally contain a crosslinker incorporated during polymerization of the monomers and/or by post-polymerization crosslinking.

In an embodiment, the polymeric paper making additive comprises at least one natural polymer. Natural polymers have often higher amount of natural residues and higher variation in the quality/specifications, including grain size, color, charge level and distribution, than synthetic polymers due to the higher complexity of and quality variations in the naturally occurring raw materials. As the present method provides more homogeneous distribution of the polymeric paper making additive to the fibre material, it may alleviate some of the undesired effects of the higher amount of natural residues and higher variation in the quality/specification.

The natural polymer may comprise at least one polysaccharide, protein, and/or lignin compound. Preferably the natural polymer comprises at least one polysaccharide. Polysaccharides are typically available in powder form, which is beneficial as low moisture content helps in resisting microbiological degradation and/or growth polysaccharides are prone to. Therefor polysaccharides benefit greatly from the present method which allows keeping them in powder form as long as possible before using. Microbiological degradation and/or growth decreases molecular weight and alters functional groups, thereby ruining desired performance and usability. Additionally, polysaccharides can easily be modified to incorporate e.g. anionic and/or cationic and/or hydrophobic groups. In one embodiment the polysaccharide comprises at least one cellulose-based polysaccharide, alginate-based polysaccharide, guar-based polysaccharide, starch-based polysaccharide, or any combination thereof. Examples of cellulose-based polysaccharides include carboxymethylcellulose (CMC); hydroxyethyl cellulose (HEC); carboxymethylhydroxyethylcellulose (CMHEC); hydroxypropyl cellulose (HPC); alkyhydroxyalkyl celluloses, such as methylhydroxypropyl cellulose; alkyl celluloses, such as methyl cellulose, ethyl cellulose or propyl cellulose; alkylcarboxyalkyl celluloses, such as ethylcarboxymethyl cellulose; alkylalkyl celluloses, such as methylethylcellulose; hydroxyalkylalkyl celluloses, such as hydroxypropylmethyl cellulose, and any combinations thereof. Examples of guar-based polysaccharides include hydroxypropyl guar (HPG), carboxymethylhydroxypropyl guar (CMHPG), carboxymethyl guar (CMG), and any combinations thereof. Examples of starch-based polysaccharides include oxidized starch, starch phosphate, hydroxy-propylated starch, hydroxyethyl starch, carboxymethylated starch, and any combinations thereof.

Preferably the polysaccharide comprises at least one cellulose-based polysaccharide, starch-based polysaccharide, or any combination thereof, as these polysaccharides are easily available, and relatively inexpensive. Furthermore, there are various cellulose-based and starch-based polysaccharides available having high molecular weight and thus especially beneficial for improving paper strength. Most preferably the polysaccharide comprises at least one cellulose-based polysaccharide, as these have the advantage of high compatibility with cellulosic paper making fibres due to structural similarities.

In an embodiment the polysaccharide, especially cellulose-based polysaccharide such as CMC, has degree of polymerization of about 100-5000, preferably 200-4000.

In an embodiment the cellulose-based polysaccharide such as CMC, has molecular weight of about 50 000-2 000 000 Da, preferably 80 000-1 000 000 Da.

In an embodiment the cellulose-based polysaccharide comprises microfibrillar cellulose.

In an embodiment the polysaccharide comprises at least one anionic polysaccharide, preferably at least one anionic cellulose-based polysaccharide, anionic alginate-based polysaccharide, anionic guar-based polysaccharide, anionic starch-based polysaccharide, or any combination thereof. Preferably the polysaccharide comprises at least one anionic cellulose-based polysaccharide.

In an embodiment the anionic cellulose-based polysaccharide comprises at least oxidized cellulose, phosphorylated cellulose, anionic cellulose ether, or any combination thereof. Suitably the anionic cellulose-based polysaccharide comprises at least one anionic cellulose ether. Examples of anionic cellulose ethers include carboxymethylcellulose (CMC); carboxymethyl hydroxyethyl cellulose (CMHEC); carboxymethyl methyl cellulose (CMMC); and any combination thereof. A particularly preferred example of anionic cellulose ether is carboxymethylcellulose (CMC).

Examples of anionic guar-based polysaccharides include carboxymethylhydroxypropyl guar (CMHPG), carboxymethyl guar (CMG), and any combinations thereof. Examples of anionic starch-based polysaccharides include oxidized starch, phosphorylated starch, carboxymethylated starch, and any combinations thereof.

In an embodiment the polymeric paper making additive comprises carboxymethyl cellulose (CMC), microfibril cellulose (MFC), guar, chitosan, cationic starch or any combination thereof, preferably CMC.

Preferably the polymeric paper making additive is water-soluble. Herein, by term water-soluble is meant that the polymeric paper making additive contains at most 50 weight-%, preferably at most 30 weight-%, more preferably at most 20 weight-%, even more preferably at most 10 weight-%, of water-insoluble material.

It is believed, without bounding to any theory, that the water-solubility improves the availability of the functional groups, like charged groups, of the polymeric papermaking additive, thereby improving the interaction with any subsequently added papermaking agents as well as the other constituents present in the fiber stock e.g. comprising opposite charge. By way of example, using a water-soluble polymeric paper making additive having net anionic charge at pH 7 in the present process provides improved interaction with cationic agent(s) added to the stock after deflaking and refining.

The polymeric paper making additive may have net anionic, net cationic or net neutral charge at pH 7. As used herein, expressions net anionic, net cationic and net neutral charge allows in each case presence of anionic and/or cationic charges, as long as their proportions provide net anionicity, net cationicity or net neutral charge at pH 7. The polymeric paper making additive may also be void of electrical charge. Preferably the polymeric paper making additive comprises charged groups, and more preferably it has a net anionic or net cationic charge at pH 7. Early addition to the paper making process may be especially beneficial for charged additives, such as net anionic or net cationic additives, as these have typically greater ability for interactions with other stock constituents, but may be more challenging to get homogenously distributed to the stock due to the electrostatic repulsive and/or attractive forces towards anionic cellulose fibers. Furthermore, when added during slushing, they may provide better dispersing and/or stabilizing effect compared to uncharged additives.

Preferably the polymeric paper making additive has a net anionic charge at pH 7. The polymeric paper making additive may have a charge density of less than −0.1 meq/g (dry), preferably less than −0.5 meq/g (dry), more preferably less than −1.0 meq/g (dry), even more preferably −1.6 . . . −2.6 meq/g (dry), most preferably −1.8 . . . −2.5 meq/g (dry), at pH 7.

Charge density may be determined at pH 7.0 by charge titration, using polyethylene sulfonate solution as titrant and Mütek PCD-03 for end point detection. pH of the polymer solution is adjusted to pH 7.0 with dilute acid or alkali before the charge density determination.

When using an anionic polymeric papermaking additive in the present process, it is possible to increase anionic sites in the fibre stock, with more even distribution, thereby improving retention of cationic papermaking agents, such as cationic starch or cationic wet strength resins, and paper strength characteristics. This may be especially beneficial when the anionic polymeric papermaking additive is added to fibres having low anionicity, such as recycled fibre materials (RCF). These embodiments facilitate also dosage reduction of cationic papermaking agents, for example of cationic wet strength resin like PAE, e.g. as much as 20%, while still achieving the targeted strength specifications. This is highly desired as e.g. unretained wet strength resin is known to cause deposits and felt plugging.

The anionic polymeric paper making additive benefits from being worked with the fiber stock before deflaking and/or refining of the stock, as the anionic polymeric paper making additive do not have charge-based affinity, but electrostatic repulsive forces exist towards the anionic cellulose fibers. The early working of the anionic polymeric paper making additives with the anionic fibers further enhances the performance of the anionic polymeric paper making additive gets more intimately and homogeneously distributed into the fiber stock.

Typically, the temperature of the stock in the slushing system and/or in the fibre lines, or in the pulper, is at least 20° C. In an embodiment the temperature in the slushing system and/or in the fibre lines, preferably in the pulper, is at least 40° C., preferably at least 45° C., more preferably 45-80° C., even more preferably 45-60° C. Elevating the temperature reduces energy consumption and time of slushing remarkably. When the temperature is 45-80° C., reduced energy consumption and time of slushing may be achieved, while being able to slush broke or recycled fibre materials comprising strong paper grades such as heavily sized, coated and supercalendered papers or papers containing wet-strength resin. On the other hand, going above 60° C. does not decrease the slushing time much.

In an embodiment, consistency of the stock in the slushing system and/or fibre lines, especially in the pulper, is at least 4 wt. %, preferably 4-20 wt. %, more preferably 4-10 wt. %, most preferably 4-6 wt. % at time and point of addition of the polymeric paper making additive.

In an embodiment, pH of the stock in the slushing system and/or in the fibre lines, especially in the pulper, is in the range of 5-8, preferably in the range of 5.5-8, at time and point of addition of the polymeric paper making additive.

The stock may comprise any fibre stock suitable for papermaking including broke, recycled fibre material (RCF) such as OCC, chemical pulp such as kraft pulp, semi-chemical pulp such as chemi-thermomechanical pulp (CTMP), mechanical pulp, such as thermomechanical pulp (TMP), pressurized groundwood pulp (PGW), alkaline peroxide mechanical pulp (APMP), stone groundwood pulp (SGW), or refiner mechanical pulp (RMP), or any combination thereof.

In a preferred embodiment the polymeric paper making additive is added to a stock comprising recycled fibre material (RCF), semi-chemical pulp such as chemi-thermomechanical pulp (CTMP), mechanical pulp and/or broke. The chemical pulp, semi-chemical pulp, or mechanical pulp may be bleached or unbleached.

The broke may be any suitable dry and/or wet broke, such as uncoated broke, coated broke, surface-sized broke, creped broke, or any combination thereof.

The deflaked and/or refined stock is directed to a headbox for forming a web in a known manner. The formed web is drained e.g. on a wire or a fabric. During draining excess water is removed and collected as whitewater, that may be circulated to a whitewater silo wherefrom it can be re-used for diluting thick stock to thin stock using a dilution pump or fan pump. The fibre stock may be directed to a mixing chest and/or to a machine chest before the optional dilution of the stock with whitewater. The formed and drained web is dried at drying section of the paper machine.

In an embodiment a stock comprising the added polymeric papermaking additive, especially a stock comprising broke and/or RCF, is directed to a thickener wherein water is removed from the stock by filtration. The thickening step may be conducted at any suitable stage e.g. after the pulper, deflaker or refiner. This may be desired to minimize storage volumes, to increase consistency, and to even out consistency fluctuations. During thickening, the presence of the polymeric papermaking additive may improve fines retention and filtrate clarity.

In a preferred embodiment the stock is not washed after the addition of the polymeric papermaking additive. This provides the benefit that unbound polymeric papermaking additive, fines, or other material is not lost from the stock, but the yield of the process and effect of the polymeric papermaking additive may be increased.

In an embodiment the process further comprises combining two or more of stocks of dried fibres and/or never-dried fibres before and/or after deflaking and/or refining the stock. In an embodiment the polymeric paper making additive is added to one or more of the stocks of dried fibres. The embodiments combining different stocks provide the benefit that lower quality stocks of dried fibres may be used for the manufacture of paper or board still achieving the targeted paper/board properties such as strength, and improvements in paper machine runnability. It is preferred to add the polymeric paper making additive to a stock that benefits most from the addition e.g. to the weakest fibres and/or containing the most hydrophobics, pigments (ash), etc., such as to a stock of dried fibres comprising RCF, semi-chemical pulp such as chemi-thermomechanical pulp (CTMP), mechanical pulp and/or broke.

The dosage of the polymeric paper making additive may vary depending e.g. on the charge density and molecular weight of the polymer, properties of the fibre stock, and the desired properties of the paper or board. In an embodiment the dosage of the polymeric paper making additive is 0.5-3 kg/ton (dry/dry) of produced paper or board, preferably 1-2 kg/ton (dry/dry) of produced paper or board.

In a preferred embodiment at least one cationic agent is added to the stock after deflaking and/or refining. Preferably the cationic agent is added to thick stock, especially when strength and/or retention improvement is desired, but it may also be added to thin stock, especially when drainage improvement is desired, or both to thick stock and to thin stock, especially when strength and/or retention, and drainage improvements are desired. The cationic agent may be added at single or multiple dosing points to thick stock to mixing chest, to machine chest, before dilution pump, or to white water silo to be combined with the thick stock upon dilution thereof, and/or to thin stock after the dilution pump but before the headbox.

The cationic agent may comprise an inorganic cationic agent, an organic cationic agent or any combination thereof.

The at least one cationic agent may comprise alum, polyaluminium chloride (PAC), polyvinylamine (PVAM), polyethylene imine (PEI), homopolymer or copolymer of diallyldimethylammonium chloride (DADMAC), polyamine, cationic polyacrylamide-based solution polymer, cationic starch, cationic reactive strength resin, or any combination thereof. Preferably the at least one cationic agent comprises cationic reactive strength resin or any combination thereof, more preferably cationic reactive strength resin selected from the group consisting of polyamidoamine-epichlorohydrin resins (PAE), glyoxalated polyacrylamide resins (GPAM), urea formaldehyde resins (UF), melamine formaldehyde resins, and any combinations thereof.

Dosage of the cationic agent may depend on the amount of the polymeric paper making additive added before deflaking and/or refining, and its charge density, as well as on the charge density of the cationic agent. Preferably the cationic agent is added in an amount bringing the zeta potential of the stock relatively close to zero, such as within 20 mV from zero (−20 . . . +20 mV), or within 10 mV from zero (−10 . . . +10 mV), for improving retention. In an exemplary process, the dosage of the cationic agent may be selected so that zeta potential of the stock after the addition of the cationic agent is in the range of −300 to −10 mV, or −50 to −20 mV.

An advantage of the present process is that lower dosages of expensive cationic agent may be needed, due to its improved retention especially when the polymeric paper making additive added before deflaking and/or refining is anionic. Another advantage is that increased amounts of In an embodiment a sizing agent may be added to the stock. The sizing agent may be any suitable sizing agent, such as ASA, AKD, rosin or a combination thereof. This embodiment has the benefit that by the present process the sizing level may be improved, or same sizing specification achieved by lower size dosage. This is believed to be attained at least by improved fines retention achieved by the present process. As sizing agents typically associate with the fines present in the fibre stock, improved fines retention improves also the sizing performance. Also, direct retention and fixation of the sizing agent to the fibres may occur.

Amount of the sizing agent depends on paper or board quality to be produced. Additionally, different internal sizing agents require different dosage amounts. For example, an effective amount of ASA to be added may be in the range of 0.2-5 kg (dry)/ton paper or board, preferably 0.7-3 kg (dry)/ton paper or board. An effective amount of AKD to be added may be in the range of 0.2-4 kg (dry)/ton paper or board, preferably 0.7-2 kg (dry)/ton paper or board. An effective amount of rosin resin to be added may be in the range of 0.5-10 kg (dry)/ton paper or board, preferably 1.5-3 kg (dry)/ton paper or board.

Rosin resins refer to various types of the rosin sizes, such as tall oil rosin and gum rosins. Examples of rosin resins include fortified rosin sizes, such as rosins at least partially reacted with maleic anhydride and/or fumaric acid, and cationic rosin sizes, such as rosin soap sizes. The rosin resins are typically available in a usable form. Also, AKD is typically available in a usable dispersion. ASA is typically emulsified on-site due to its high reactivity, by using separate emulsifying equipment, and it is typically used directly without any intermediate storage. A hydrophobic internal sizing agent may be formulated, i.e. emulsified and/or stabilized with e.g. cationic starch. Also, other polymers, such as polyamine may be used. A dosage point may depend on the manufacturing process and the paper or board to be manufactured.

In the present process any further papermaking additives may be added to the fibre stock in conventional manner including fillers, OBA, biocides, strength agents, brightening agents, colours, retention aids, drainage aids, flocculants, washing aids, defoamers, dispersing agents, nanoparticles, microparticles, fixatives, coagulants, and any combination thereof.

With the process of the present invention any paper and board grade can be produced where at least one strength attribute, such as wet tensile strength, dry tensile strength, z-directional tensile strength, tensile stiffness, elastic modulus, burst strength, compression strength measured by Short-Span Compressive Test (SCT), Concora medium test (CMT) value, or Scott bond, needs to be increased beyond the level the fibers in the stock can deliver. The treatment with the polymeric paper making additive, especially of high molecular weight, before deflaking and/or refining enhances the bonding efficiency.

With the process of the present invention several paper and board grades with enhanced properties can be produced. As used herein, by paper is meant also various tissues and towels.

Examples of the paper or board obtainable by the present process include tissues, napkins, towels, graphical papers, coated fine paper, uncoated fine paper, mechanical papers, newsprint, packaging papers, folding boxboard, high performance testliners and media, solid board, multi-layered specialty board, liner, fluting, gypsum board liner, wall paper, core board, carrier board, boxboard (FBB), white lined chipboard (WLC), solid bleached sulphate (SBS) board, solid unbleached sulphate (SUS) board and liquid packaging board (LPB).

For example, tissues, napkins and towels obtainable by the present process may have enhanced wet and dry strength.raphical papers, such as coated and uncoated fine papers as well as mechanical papers including newsprint obtainable by the present process may have increased filler loading and enhanced coating without folding problems, due to the improved bonding ability of the fibres and paper strength.

In an embodiment the paper or board obtainable by the present process contains the polymeric paper making additive and a sizing agent, wherein the paper or board is selected from liner, fluting, gypsum board liner, wall paper, core board, folding boxboard (FBB), white lined chipboard (WLC), solid bleached sulphate (SBS) board, solid unbleached sulphate (SUS) board or liquid packaging board (LPB) such as cup stock. This embodiment is beneficial as the present process enhances both sizing performance and at least one strength characteristic of the paper or board.

The embodiments of the present disclosure described in this specification may be combined, in whole or in part, with each other to form further embodiment(s) of the present disclosure. Further, the particular features or characteristics illustrated or described in connection with various embodiments may be combined, in whole or in part, with the features or characteristics of one or more other embodiments without limitation. Such modifications and variations are intended to be included within the scope of the present disclosure. A process or a paper or board, to which the present disclosure is related, may comprise at least one of the embodiments of the present disclosure described in this specification.

The following Examples describes some embodiments according to the present invention. The Examples are not intended to limit the present invention.

EXAMPLES

Example 1

In FIG. 1 is presented a chart of an embodiment according to the present invention. The process comprises: High molecular weight polymeric papermaking additive (A) is added as powder or aqueous dispersion to pulper (1) containing stock of dried fibres. The high molecular weight polymeric papermaking additive distributes homogenously to the stock in the pulper. The stock is directed to a deflaker and/or refiner (2) from which the deflaked and/or refined stock is directed to mixing chest (3) and therefrom to machine chest (4). Thereafter the stock is diluted with white water from white water silo (5) to obtain thin stock, that is directed to a headbox (6) for forming a web followed by drying the web. The optional cationic agent may be added to mixing chest (3), machine chest (4), white water silo (5), before dilution pump (DP), or to the thin stock after the dilution pump (DP) but before the headbox (6).

Example 2

Figure 2:
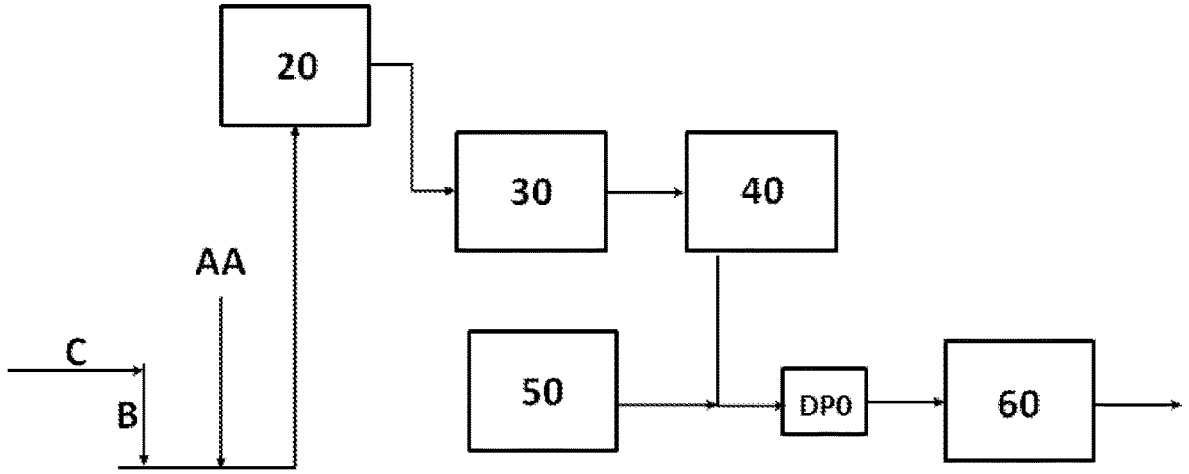
FIG. 2 represents another example of the process according to the present invention, wherein high molecular weight polymeric paper making additive is added to fibre lines of an integrated paper mill.

In FIG. 2 is presented a chart of another embodiment according to the present invention. The process comprises: High molecular weight polymeric papermaking additive (AA) is fed as an aqueous dispersion to fibre line containing stock of never-dried fibres before a deflaker and/or refiner (20) but after chip line (C) and bleaching line (B) of an integrated paper mill. The deflaked and/or refined stock is directed to mixing chest (30) and therefrom to machine chest (40). Thereafter the stock is diluted with white water from white water silo (50) to obtain thin stock, that is directed to a headbox (60) for forming a web followed by drying the web. The optional cationic agent may be added to mixing chest (30), machine chest (40), white water silo (50), before dilution pump (DP0), or to the thin stock after the dilution pump (DP0) but before the headbox.(60).

Example 3

The effect of the present invention on fibre refining was tested by adding 2 kg/ton of high molecular weight CMC to acacia pulp, adding the pulp to valley beater and circulating 30 min without load to disintegration. Acacia pulp without CMC addition was used as reference. Same refining times were used for pulps with and without CMC addition. Canadian freeness of the pulp was measured according to ISO 5267-2 in millilitres before and after the refining. CMC addition reduced freeness (pulp drainage in ml) by about 10% even before refining due to CMC's water holding characteristics, and after refining by about 18%, compared to reference. This shows that by using the present process higher refining level (reduced freeness) is obtainable using same energy, or that same freeness is obtainable using less energy.

The following tensile strength, Z-directional strength and bulk tests were conducted on 80 gsm handsheets made from acacia pulp refined as above.

The effect of the present invention on tensile strength compared to cationic starch was tested. Handsheets were prepared #1 with 0.5 kg/ton polyamine added to thick stock (reference), #2 with 2 kg/ton CMC added to pulper and 0.5 kg/ton polyamine to thick stock, and #3 with 8 kg/ton cationic starch and 0.5 kg/ton polyamine added to thick stock. Elongation (%) (ISO 1924-3) was found to increase in #2 by about 34%, and #3 by 20%, compared to #1 reference. Breaking length (km) (ISO 1924-1) was found to increase in #2 by about 40%, and #3 by 14%, compared to #1 reference. This shows that by using the present process, tensile strength of the paper can be increased beyond the level achievable by conventional cationic starch thick stock dosage.

The effect of the present invention on Z-directional strength (ZDT) compared to cationic starch was tested. Handsheets were prepared #1 with 0.5 kg/ton polyamine added to thick stock (reference), #2 with 2 kg/ton CMC added to pulper and 0.5 kg/ton polyamine to thick stock, #3 with 8 kg/ton cationic starch and 0.5 kg/ton polyamine added to thick stock, and #4 with 2 kg/ton CMC added to pulper, and 0.5 kg/ton polyamine and 8 kg/ton cationic starch added to thick stock. ZDT (kPa) (ISO 15754) was found to increase in #2 by 23%, #3 by 7%, and #4 by 34%, compared to #1 reference. This shows that by using the present process ZDT can be greatly increased, and that there is even a synergistic effect on ZDT when the present process is used together with a conventional cationic starch thick stock dosage.

The effect of the present invention on paper bulk compared to cationic starch was tested. Handsheets were prepared #1 with 0.5 kg/ton polyamine added to thick stock (reference), #2 with 2 kg/ton CMC added to pulper and 0.5 kg/ton polyamine to thick stock, #3 with 8 kg/ton cationic starch and 0.5 kg/ton polyamine added to thick stock, and #4 with 2 kg/ton CMC added to pulper, and 0.5 kg/ton polyamine and 8 kg/ton cationic starch added to thick stock. Bulk (g/cm3) (ISO 534) was found to decrease in #2 by <1%, to increase in #3 by 2.6%, and to decrease in #4 by 4.3%, compared to #1 reference. In combination with the strength test results, this test shows that by using the present process it is possible to improve various strength characteristics while maintaining the bulk essentially same, or with only slight decrease in the bulk.

The following tensile strength, Z-directional strength and bulk tests were conducted on handsheets made from acacia pulp refined using valley beater with 450 ml Canadian standard freeness (CSF) level, first disintegrating for 10 min and then refining the same refining time. Handsheets of 80 gsm were prepared with CMC addition either to pulper or to thick stock at dosages 0, 1, 2, 3 kg/ton, and adding 0.5 kg/ton polyamine and 8 kg/ton cationic starch to thick stock to all handsheets.

Canadian freeness of the pulp was measured according to ISO 5267-2 in millilitres before and after the refining. With dosages of at least 2 kg/ton, CMC addition reduced freeness (pulp drainage in ml) by about 3% even before refining due to CMC's water holding characteristics, and after refining by about 9%, compared to reference.

Elongation (%) (ISO 1924-3) and breaking length (km) (ISO 1924-1) were found to increase both with pulper and thick stock addition of CMC at dosage of 1 kg/ton. At higher dosages the increase in breaking length and especially in elongation was a lot lower with thick stock addition compared to pulper addition. With pulper addition both breaking length and elongation increased more linearly with increasing CMC dosage, compared to thick stock addition.

ZDT (kPa) (ISO 15754) was found to increase both with pulper and thick stock addition of CMC at dosage of 1 kg/ton, but with thick stock addition of 2 and 3 kg/ton ZDT dropped substantially. With pulper addition ZDT increased perfectly linearly with increasing CMC dosage.

Bulk ($g/cm^3$) (ISO 534) was found to be about 7% and 5% higher with CMC addition to pulper compared to thick stock addition, at dosages 1 and 3 kg/ton, respectively. At dosage of 2 kg/ton similar bulk levels were achieved with pulper and thick stock additions.

Based on the strength and bulk tests it can be seen that by using the present process it is possible to improve bulk while achieving at least the same strength characteristics, compared to adding the CMC to thick stock. As the present process achieves more even/homogeneous distribution of the polymeric papermaking additive to the fibres, the dependency of the strength characteristics on the CMC dosage is more linear, which makes the process performance and paper characteristics more predictable. Without wishing to be bound by any theory, it is believed that the more uneven distribution of the polymeric papermaking additive achieved by thick stock addition may cause more variation in the flocculation and floc size, thereby disturbing formation, which affects also paper strength characteristics.

Example 4

The performance of the present invention was tested at paper machine producing towel grade paper (grammage about 20 $g/m^2$), using conventional cationic permanent wet strength resin in combination with an anionic functional promoter. When the anionic functional promoter dosage was run down and high molecular weight powdery CMC was run up to dosage of 0.9 kg/paper ton (dry/dry), added as dry powder to market pulp pulper, refiner load could be reduced, and also cationic permanent wet strength resin (PAE) dosage could be reduced by 28%, while simultaneously improving machine direction dry strength by 28% and cross-direction wet-strength by 5%. Drainage/dewatering performance of the process was not deteriorated, and the machine speed could be maintained unchanged.

Example 5

The performance of the present invention was tested at paper machine producing uncoated printing & writing grade paper (grammage about 100 $g/m^2$) with high filler load (>25%), using cationic starch addition to mixing chest, and conventional retention additive program. When high molecular weight powdery CMC was run up to dosage of 2 kg/paper ton (dry/dry) added as an aqueous dispersion to market pulp pulper, dosage of cationic starch could be increased by 79%, and Scott bond, machine direction tensile strength and burst strength improved by 23%, 14% and 9%, respectively, brightness improved by 3%, and Cobb sizing improved by 56%. Drainage/dewatering performance of the process was not deteriorated, and the machine speed could be maintained unchanged. When the CMC program was changed from addition as aqueous dispersion to pulper to addition as aqueous solution to thick stock (to machine chest), pinhole like deposits appeared on paper, and the combination of benefits of pulper addition was not achieved.

Example 6

The performance of the present invention was tested at paper machine producing smooth specialty paper (grammage about 55 $g/m^2$) with moderate filler load (about 10%), using cationic permanent wet strength resin (PAE), anionic charge control agent, internal sizing agent, and conventional retention additive program. When the anionic charge control agent was run down and high molecular weight powdery CMC was run up to dosage of 1 kg/paper ton (dry/dry) added as an aqueous dispersion to market pulp pulper, permanent wet strength resin dosage could be reduced by 10% and internal sizing agent dosage by 30%, while simultaneously maintaining or even slightly improving physical properties of paper including internal bond, machine and cross-direction dry and wet tensile strength, formation, and sizing (Cobb). Paper smoothness (measured as seconds) was improved significantly, by 25% for top ply and by 42% for bottom ply. Drainage/dewatering performance of the process was not deteriorated and the machine speed could be maintained unchanged.

Example 7

The performance of the present invention was tested at paper machine producing specialty paper with high filler load (about 20 w %), using cationic starch addition to mixing chest, internal sizing agent, and conventional retention additive program. When high molecular weight powdery CMC was run up to dosage of 1 kg/paper ton (dry/dry) added as an aqueous dispersion to market pulp pulper, dosage of cationic starch could be increased by 50% and internal bond improved by 25-33%, while simultaneously reducing fibre usage. In a further test it was possible to increase filler load to about 25 w % while maintaining the original target internal bond strength. Drainage/dewatering performance of the process was not deteriorated and the machine speed could be maintained unchanged. No pinhole like deposits were observed on paper.

The invention claimed is:

1. A process for producing paper or board, comprising:
slushing a stock of dried fibres in a slushing system comprising a pulper, and/or feeding a stock of never-dried fibres in a fibre line of an integrated paper mill;
adding a polymeric strength additive comprising at least one polysaccharide to one or more of the stocks of dried fibres and never-dried fibres into the pulper or to the fibre line;
deflaking and/or refining the stock in a deflaker and/or a refiner;
directing a deflaked and/or refined stock from the deflaker and/or refiner into a mixing chest and from the mixing chest to a machine chest;
obtaining a thin stock by diluting the deflaked and/or refined stock with white water from a white water silo;
directing the the thin stock to a headbox;
forming a web; and
drying the web;
wherein the polymeric strength additive has an intrinsic viscosity of at least 200 ml/g, and
wherein consistency of the stock in the slushing system and/or in the fibre lines is 4-20 wt. % at the time and point of the addition of the polymeric strength additive.

2. The process according to claim 1, wherein the polymeric strength additive is added to the one or more of the stocks as a powder and/or as an aqueous dispersion.

3. The process according to claim 1, wherein the polymeric strength additive is added to the stock of dried fibres.

4. The process according to claim 1, wherein the polymeric strength additive has a viscosity of at most 10 000 mPas as measured from 1 weight-% aqueous polymer solution (dry/dry).

5. The process according to claim 1, wherein the polymeric strength additive comprising at least one polysaccharide comprises at least one cellulose-based polysaccharide, alginate-based polysaccharide, guar-based polysaccharide, starch-based polysaccharide, or any combination thereof.

6. The process according to claim 5, wherein the at least one polysaccharide comprises at least one cellulose-based polysaccharide comprising at least one anionic cellulose-based polysaccharide comprising at least one oxidized cellulose, phosphorylated cellulose, anionic cellulose ether, or any combination thereof.

7. The process according to claim 5, wherein the polymeric strength additive comprises at least one cellulose-based polysaccharide comprising microfibrillar cellulose.

8. The process according to claim 1, wherein the polymeric strength additive comprises at least one natural polymer and at least one synthetic polymer.

9. The process according to claim 1, wherein the polymeric strength additive has a net anionic or net cationic charge at pH 7.

10. The process according to claim 1, wherein the polymeric strength additive has a charge density of less than −0.1 meq/g (dry) at pH 7.

11. The process according to claim 1, wherein the polymeric strength additive contains at most 50 weight-% of water-insoluble material.

12. The process according to claim 1, wherein temperature of the stock in the slushing system and/or in the fibre lines is at least 40° C.

13. The process according to claim 1, wherein consistency of the stock in the slushing system and/or in the fibre lines is 4-10 wt. % at the time and point of the addition of the polymeric strength additive.

14. The process according to claim 1, wherein pH of the stock in the slushing system and/or in the fiber lines is in the range of 5-8 at the time and point of the addition of the polymeric strength additive.

15. The process according to claim 1, wherein the polymeric strength additive is added to a stock comprising recycled fibre material (RCF), semi-chemical pulp such as chemi-thermomechanical pulp (CTMP), mechanical pulp and/or broke.

16. The process according to claim 1, wherein at least one cationic agent comprises alum, polyaluminium chloride (PAC), polyvinylamine (PVAM), polyethylene imine (PEI), homopolymer or copolymer of diallyldimethylammonium chloride (DADMAC), polyamine, cationic polyacrylamide-based solution polymer, cationic starch, cationic reactive strength resin, or any combination thereof is added to the stock after deflaking and refining.

17. A paper or board obtainable by the process according to claim 1, wherein the paper or board is selected from tissues, napkins, towels, graphical papers, coated fine paper, uncoated fine paper, mechanical papers, newsprint, packaging papers, folding boxboard, high performance testliners and media, solid board, multi-layered specialty board, liner, fluting, gypsum board liner, wall paper, core board, carrier board, boxboard (FBB), white lined chipboard (WLC), solid bleached sulphate (SBS) board, solid unbleached sulphate (SUS) board and liquid packaging board (LPB).

18. The process according to claim 1, wherein the polymeric strength additive is added to the pulper.

19. The process according to claim 1, wherein the polymeric strength additive has a viscosity of 50-5500 mPas measured from 2 weight-% aqueous polymer solution (dry/dry).

* * * * *